US006931140B2

(12) United States Patent
Van Halteren et al.

(10) Patent No.: US 6,931,140 B2
(45) Date of Patent: Aug. 16, 2005

(54) ELECTRO-ACOUSTIC TRANSDUCER WITH TWO DIAPHRAGMS

(75) Inventors: Aart Zeger Van Halteren, Hobrede (NL); Leif Johannsen, Odder (DK)

(73) Assignee: Sonionkirk A/S, Horsens (DK)

( * ) Notice: Subject to any disclaimer, the term of this patent is extended or adjusted under 35 U.S.C. 154(b) by 192 days.

(21) Appl. No.: 10/238,857

(22) Filed: Sep. 11, 2002

(65) Prior Publication Data

US 2003/0048920 A1 Mar. 13, 2003

Related U.S. Application Data

(60) Provisional application No. 60/318,798, filed on Sep. 11, 2001.

(30) Foreign Application Priority Data

Sep. 11, 2001 (DK) ..... 2001 01325

(51) Int. Cl.[7] ..... H04R 25/00; H04R 7/04

(52) U.S. Cl. ..... 381/182; 381/418; 381/423; 181/173

(58) Field of Search ..... 381/182, 423, 381/401, 410, 418, 419, 424, 431; 181/157, 161, 163, 173

(56) References Cited

U.S. PATENT DOCUMENTS 3,803,547 A * 4/1974 Massa ..... 367/175
4,472,605 A * 9/1984 Klein ..... 381/186
4,544,805 A * 10/1985 Sawafuji ..... 381/410
4,924,504 A * 5/1990 Burton ..... 381/427
2003/0002696 A1 * 1/2003 Mazarakis ..... 381/152

FOREIGN PATENT DOCUMENTS

| | | | |
|---|---|---|---|
| JP | 57-154998 | 12/1982 | ..... H04R/13/80 |
| JP | 62250622 A * | 10/1987 | ..... H01F/41/04 |
| JP | 7-131893 | 9/1995 | ..... H04R/9/06 |
| JP | 09289115 | 11/1996 | ..... H01F/6/06 |
| JP | 11-308691 | 11/1999 | ..... H04R/1/40 |
| JP | 2000-165987 | 6/2000 | ..... H04R/7/12 |

* cited by examiner

*Primary Examiner*—Curtis Kuntz
*Assistant Examiner*—Brian Ensey
(74) *Attorney, Agent, or Firm*—Harness, Dickey & Pierce, PLC

(57) ABSTRACT

The present invention relates to an electro-acoustic transducer suitable for applications within mobile communication equipment and hearing aids. The transducer comprises two diaphragms positioned on opposite sides of a magnetic circuit having two magnetic gaps. When used as a microphone the transducer is substantially insensitive to vibrations, and when used as a speaker the transducer generates only very low vibration levels. The magnetic circuit has a number of advantages compared to conventional transducers with circular magnetic. The transducer can be made lightweight and with very compact dimensions compared to conventional designs. In a preferred embodiment the diaphragms are rectangular. The transducer may additionally be used as a vibration generator for silent alarm signals.

25 Claims, 9 Drawing Sheets

ELECTRO-ACOUSTIC TRANSDUCER WITH TWO DIAPHRAGMS

This application claims benefit of 60/318,798 filed on Sep. 11, 2001.

FIELD OF THE INVENTION

The present invention relates to electro-acoustic transducers, and in particular to electro-dynamic transducers with two diaphragms each carrying a coil of electrically conducting wire movable in a magnetic field.

BACKGROUND OF THE INVENTION

Electro-acoustic transducers, and in particular electro-dynamic transducers, are widely used in e.g. telecommunication equipment such as wired, mobile or cellular telephones, and hearing aids where small size is a requirement. Both transducers used as microphones and loudspeakers (speakers) are used for transforming acoustical signals into electrical signals and vice versa. For both microphones and speakers to be used in miniature equipment it is essential that the transducer is tolerant with respect to vibrations in order to avoid unintended noise or feedback problems.

With a microphone and speaker placed close to each other, such as especially in hearing aids, a feedback loop may occur due to vibrations created by the speaker. The vibrations from the speaker are transmitted via the housing to the microphone which, to a certain degree, will convert the vibration to an electrical signal being amplified and again converted to sound and vibrations via the speaker, thus creating an unintended feedback loop. Such loops may lead to reduced sound quality. In case of large gains, such as in hearing aids, the mentioned feedback loops may even lead to disturbing howling sounds, and thus being a limiting factor in the maximum possible gain of the hearing aid.

In prior art, a rubber boot construction or a box-in-a-box construction has been used to establish vibration isolation. In the box-in-a-box construction the receiver was mounted in a very compliant gasket to obtain the necessary vibration isolation. The extra housing can also be used as magnetically shielding when a hearing aid including a tele-coil is used.

Another way of providing vibration isolation is to apply two identical receivers (dual receiver) coupled back-to-back and thereby reduce vibrations from the overall system.

A disadvantage of the rubber boot construction is that it does not provide enough vibration isolation and it is very difficult to design and control the design parameters. The box-in-a-box construction easily gets very large and bulky.

The dual receiver construction does not completely cancel out vibrations because such a receiver always generate rotational components when using balanced armature receivers, such as used within hearing aids. When using a dual receiver or a speaker with two traditional radial electro-dynamic transducers, a larger degree of vibration isolation can be obtained. Furthermore, for mobile phones such a transducer may be used as vibration generator, for generating a silent alarm signal, thus, saving weight and space for a separate vibration generator.

JP 11 308691 A (abstract in english) describes a speaker system comprising two diaphragms and one common magnetic circuit. As the two diaphragms move in opposite directions, the vibration force provided to the magnetic circuit is minimised, and the electroacoustic efficiency is increased compared to one diaphragm speakers. However, the speaker system described in JP 11 308691 A has a disadvantage since its magnetic circuit and the diaphragms are circular with the entire coil positioned in the circular magnetic gap. Therefore, in order for such a speaker to provide low distortion the design is critical with respect to production tolerances, such as centering of the voice coil. In addition, the magnetic circuit is bulky and is thus not suited for applications with very limited space available, especially with respect to the height of the speaker system. Furthermore, the speaker system of JP 11 308691 A requires a large number of single components, and therefore it is not suited for low cost mass production.

JP 07 131893 A (abstract in english) describes a two diaphragm speaker with one common magnetic circuit. The speaker described in JP 07 131893 A aims at radiating highly bidirectional sound without phase deviation. This is obtained by integrating two oscillating systems into one body. The diaphragms and magnetic circuit are circular, and the entire circular voice coil is positioned in the magnetic gap. The design has a number of disadvantages. The design is bulky by nature, since it relates to the art of superior bidirectional speakers where parameters such as size and weight is not important. The speaker of JP 07 1131893 A is therefore not suited for miniature design. In addition, the above mentioned problem concerning distortion caused by non perfect symmetry in the magnetic circuit is not solved. Furthermore, due to the large number of single components and complicated geometry the design is not suited for low cost mass production.

Thus, there is a need for an electro-acoustic transducer with two diaphragms being substantially vibration insensitive, in case it is used as a microphone, and substantially vibration free in case it is used as a speaker. The transducer must be suited for miniature applications such as telecommunication equipment and hearing aids.

SUMMARY OF THE INVENTION

It is an object of the present invention to provide an electro-acoustical transducer of very compact dimensions for general use in telecommunication equipment and hearing aid devices.

It is a further object of the present invention to provide an electro-acoustic transducer having the following characteristics:

1. dual speaker with common magnetic circuit and two diaphragms, 2. two possible modes of operation: vibration cancelling mode or vibration generating mode, and 3. high efficiency due to optimised magnetic circuit with low leakage.

According to the present invention, the above-mentioned objects are complied with by providing, in a first aspect, an electro-acoustic transducer comprising

- a magnetic circuit having a first and a second gap, each of the first and second gaps having an upper and a lower portion, the magnetic circuit further comprising magnetic means so to establish a magnetic field in the first and second gaps,
- a first and a second diaphragm situated on opposite sides of the magnetic circuit,
- a first coil of electrically conducting wire fastened to the first diaphragm, the first coil having first and second gap portions of its wire situated in respective ones of the upper portions of the first and second gaps, the first coil further having bridging portions of wire interconnecting the first and second gap portions of wire, the first coil being fastened to the first diaphragm at least at the bridging portions of the wire, and a second coil of electrically conducting wire fastened to the second diaphragm, the second coil having first and second gap portions of its wire situated in respective ones of the lower portions of the first and second gaps, the second coil further having bridging portions of wire interconnecting the first and second gap portions of wire, the second coil being fastened to the second diaphragm at least at the bridging portions of the wire.

The first coil may be fastened to the first diaphragm along at least part of one of its gap portions as well. Similarly, the second coil may be fastened to the second diaphragm along at least part of one of its gap portions.

Each of the first and second gaps may be defined by a pair of opposed surfaces being substantially plane and substantially parallel to each other.

The magnetic means may comprise a first and a second permanent magnet, the first magnet establishing a magnetic field in the first gap, whereas the second magnet establishing a magnetic field in the second gap. The magnetic circuit may comprise a body of magnetically soft material, said body having a first and a second opening.

Preferably, the first magnet is situated within the first opening of the body, whereas the second magnet is situated within the second opening of the body.

The diaphragms may comprise electrically conductive portions, said electrically conductive portions being connected to wires ends of the coils, the electrically conductive portions being externally accessible portions for electrically terminating the transducer.

For hearing aid applications, a spatial overlap may exist between the upper and lower portions of the respective ones of the first and second gaps. This spatial overlap is introduced so as to reduce the dimensions of the transducer. For other applications it may be desirable that the upper and lower portions of respective ones of the first and second gaps are spatially separated.

In a second aspect, the present invention relates to a coil of electrically conducting wire for use in a transducer according to the first aspect of the present invention, wherein the coil comprises bridging portions defining a bridging plane with a substantially flat face for fastening to one of the diaphragms, and gap portions outside the bridging plane, each gap portion including a plurality of segments of wire outside the bridging plane.

Preferably, the segments of wire in the gap portions are substantially linear.

In a third aspect, the present invention relates to a method of manufacturing a coil from an electrically conducting wire, the method comprising producing, from an electrically conducting wire, a coil defining a coil axis, and bending the coil around two bending axes substantially perpendicular to the coil axis.

In a fourth aspect, the present invention relates to a magnetic circuit for use in a transducer according to the first aspect, the magnetic circuit comprising a magnetically conductive material formed so as to define a pair of opposed surfaces defining a gap therebetween, said gap being adapted to receive portions of a first and a second coil of electrically conducting wire, and magnetic means so to establish a magnetic field in an upper and a lower portion of the gap, the upper portion being adapted to receive portions of the first coil, the lower portion being adapted to receive portions of the second coil.

Preferably, each pair of opposed surfaces has substantially plane surfaces being parallel to each other. The magnetic means may comprise permanent magnets, each of said permanent magnets having a substantially plane surface constituting one of the substantially plane surfaces of a gap. The magnetic circuit may comprise a body of magnetically soft material formed so as to define two openings within the body, each opening having a pair of opposed surfaces defining respective ones of the first and second gaps. Preferably, the magnetic means is situated within the openings in the magnetic circuit.

In a fifth aspect, the present invention relates to a method of operating the transducer according to the first aspect, wherein the first and second diaphragms deflect in the same direction upon providing, simultaneously, the same electrical signal to the first and second coils.

In a sixth aspect, the present invention relates to another method of operating the transducer according to the first aspect, wherein the first and second diaphragms deflect in opposite directions upon providing, simultaneously, the same electrical signal to the first and second coils.

BRIEF DESCRIPTION OF THE DRAWINGS

In the following the present invention will be explained in further details with reference to the drawings, in which.

DETAILED DESCRIPTION OF THE INVENTION

Figure 1:
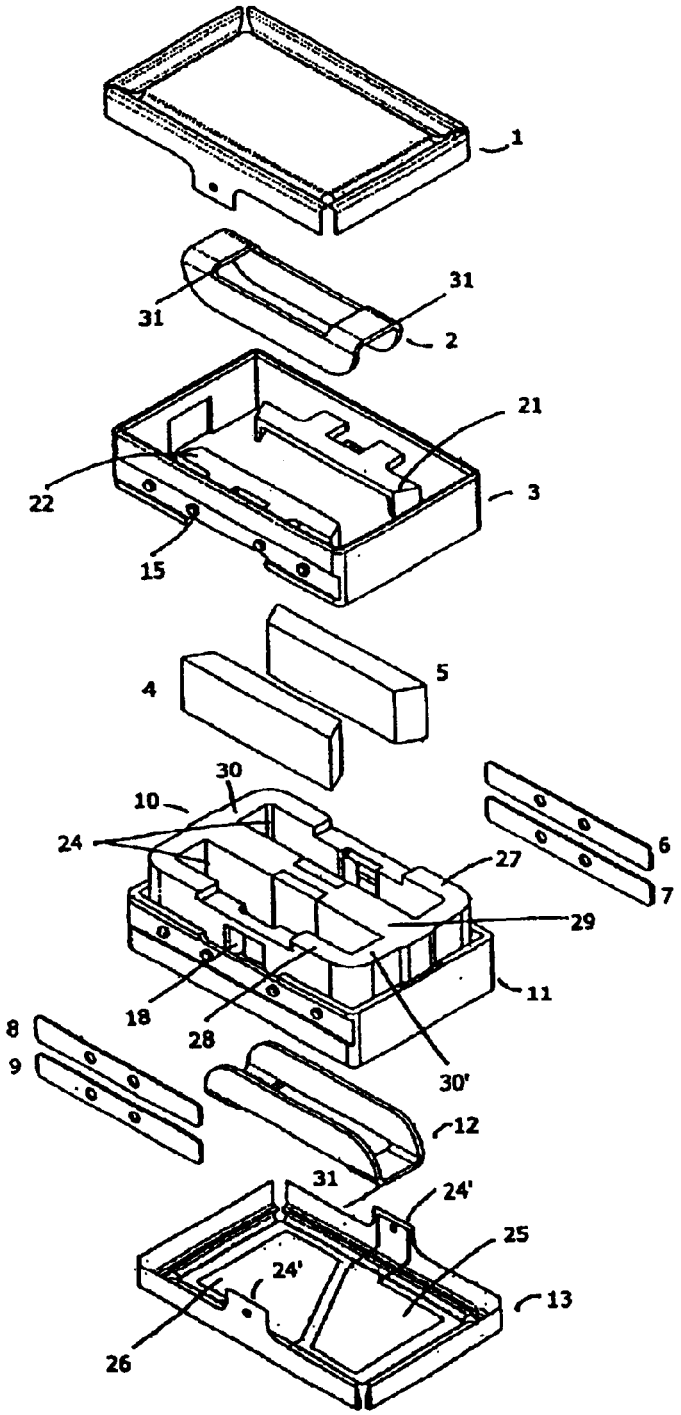
FIG. 1 is a perspective view showing an embodiment of the invention suitable for telecom applications with its essential parts exploded seen from above.
Figure 2:
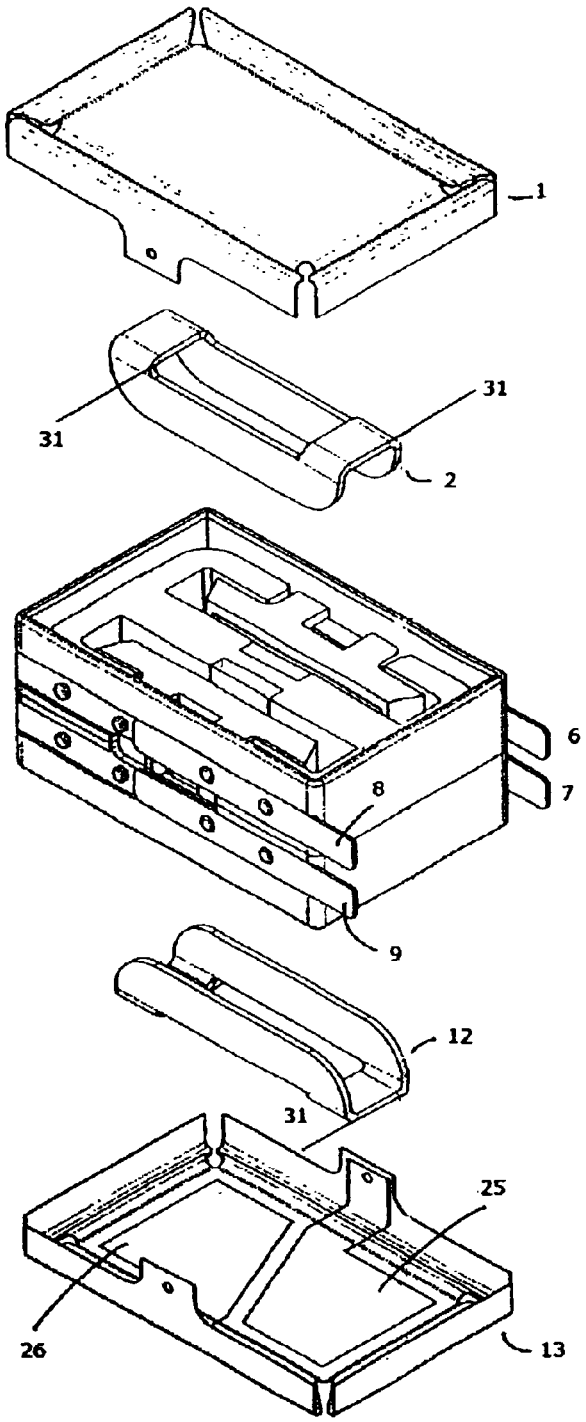
FIG. 2 shows the same parts (as in FIG. 1) partly assembled.
Figure 3:
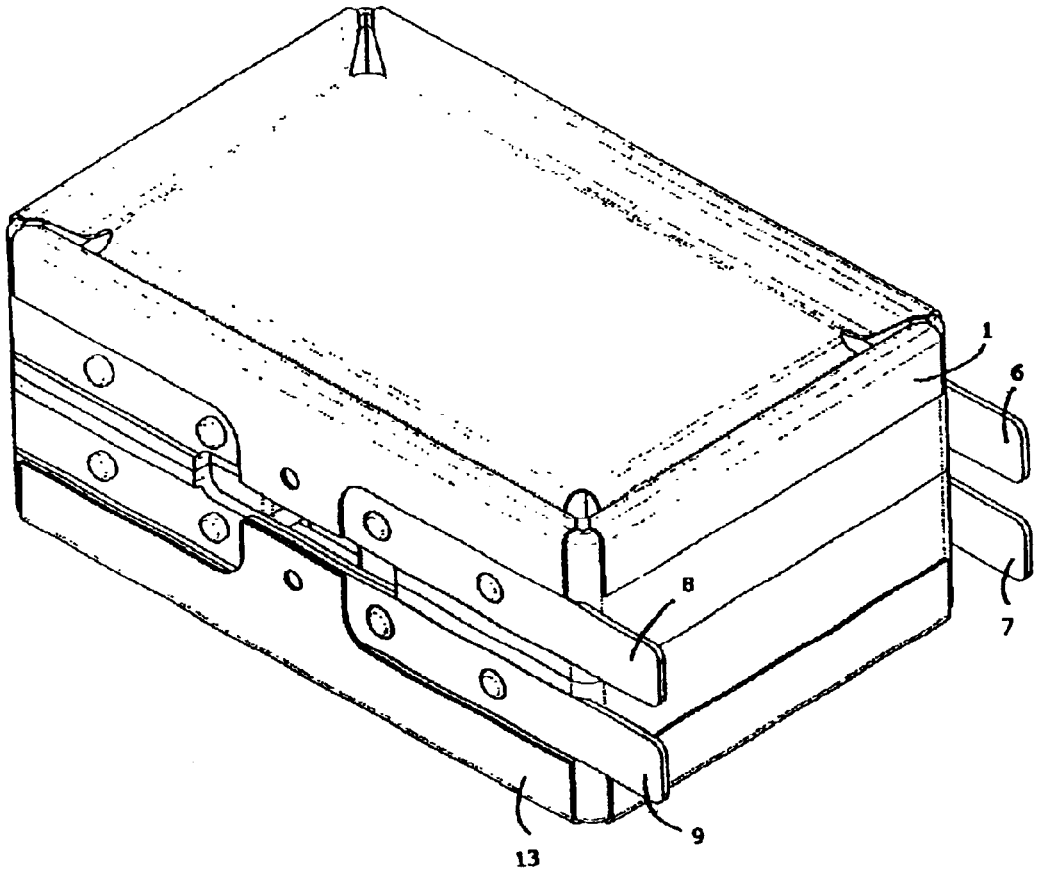
FIG. 3 shows the same parts even more assembled.

FIGS. 1–3 show an electro-dynamic transducer with its main components: a magnetic circuit 10, a first coil 2, a second coil 12, a first diaphragm 1, a second diaphragm 13, and four terminals 6–9.

As is best seen in FIG. 1, the electro-dynamic transducer according to the present invention comprises two diaphragms 1,13 and two coils 2,12 which have a common magnetic circuit. The two diaphragms may be driven in two modes of operation—either with the same polarity or in opposite polarity. In case the two diaphragms are driven in the same direction in response to an incoming electric signal, the transducer is driven in a so-called vibration mode. Vibration mode leads to maximum vibration but no sound output. In case the two diaphragms are driven in opposite directions maximum sound output is provided, and the transducer is vibration-free. Terminals 6 and 8 provide electrical contact to coil 2, whereas terminals 7 and 9 provide electrical contact to coil 12. The contact between the terminal and the coils may be provided via conducting portions of the diaphragms 25,26.The present invention is especially suitable for applications where the space available for the speaker is very limited. By using the construction according to the present invention a much better ratio between efficiency versus, volume and maximum output versus volume may be achieved.

In the following, two embodiments—one suitable for the telecom applications and one suitable for hearing aid applications—are described. It should be understood that the present invention is not limited to applications within these fields.

In FIG. 1, a two-part plastic housing 3,11 is used to keep the magnetic system in position. The magnetic system comprises a magnetic circuit 10 having two long legs 27,28 and two short legs 30,30' connected at their ends to form a ring of generally rectangular shape. A middle leg 29 interconnects the two short legs 30,30' dividing the internal of the rectangular ring into two rectangular openings. The two long legs 27,28, the two short legs 30,30' and the middle leg 29 of the magnet circuit are of a magnetically soft material preferably having a high magnetic saturation value. The surfaces of the two long legs 27,28 and of the middle leg 29 facing towards the openings 24 are generally plane and define a gap therebetween.

The middle part of the long legs are removed to accommodate part of the plastic housing 3,11 with holding rim 21,22 for the magnets 4,5 which are then positioned in openings 24. It is a goal to obtain a simple assembly procedure based on a simple stacking operation. Each magnet has a magnetic pole facing the long leg and an opposite magnetic pole facing the middle leg 29. Thus, depending on the positioning of the magnet, the magnetic gaps may be defined between free magnetic pole surfaces and the surfaces of the middle leg, or between free magnetic pole surfaces and the surfaces of the long leg.

Each magnet 4,5 creates a magnetic field in the corresponding gap, and the magnetic return paths are defined through the middle leg 29, the short legs 30,30' and the long legs 27,28. The magnetic return paths thus completely encircle the magnet gaps with the magnets each having a magnetic pole face defining a gap. This gives a very flat and compact structure of the magnet system with the magnetic field concentrated in the gaps and a low stray magnetic field, which results in a high sensitivity and less need for magnetic shielding.

Figure 6:
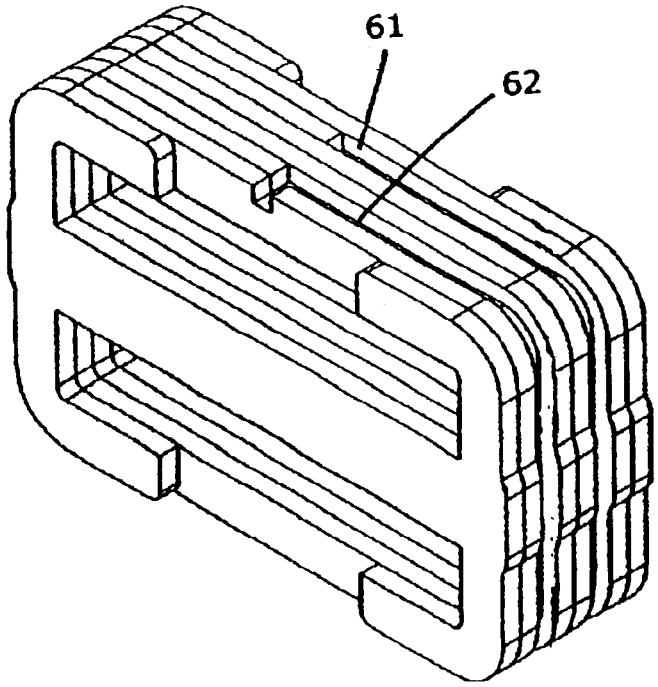
FIG. 6 shows an acoustic tunnel for providing an acoustical connection between the volume between the diaphragms and the area outside the transducer.
Figure 6:
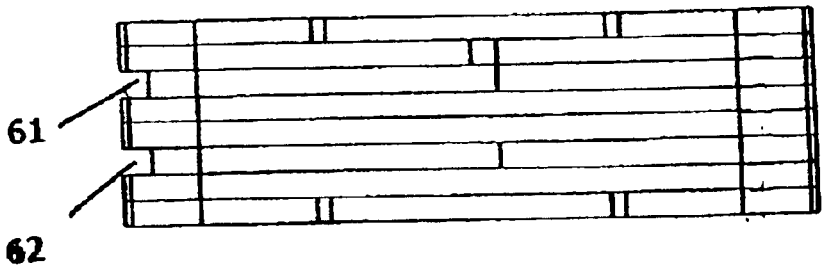

An acoustic path is provided to the outside to be able the use the volume in e.g. a mobile terminal. This acoustic path should penetrate the plastic housing and the poles shoes whereby an acoustic tunnel is created connecting the outside world to the back volume of the speaker. Acoustic damping may be achieved by adding a cloth, mesh, or in general acoustic damping material across opening 15,18. This acoustic damping material may be inductive, resistive or any combination thereof. The provided acoustic tunnel may also be used for bass reflex loading to obtain extended low frequency response as it is known from other applications. The acoustic tunnel between back volume and the outside of the transducer is also illustrated in FIG. 6, where parts of the magnetic circuit 61,62 has been removed in order to make the acoustic tunnel. As seen, the acoustic tunnel has been implemented as a long and narrow abound the edge of the magnetic circuit. With the right dimensions, such narrow tunnel will act as an acoustical low-pass filter with a cut-off frequency in the sub 1 Hz range. In FIG. 6, two tunnels run half a turn around the magnetic circuit but in principle the tunnel may be implemented having several turns and occupying more or less layers for the laminated structure forming the magnetic circuit.

The volume of the back volume may be increased by removing part of the middle leg 29 which has almost no adverse effect on the magnetic circuit since the flux density is almost zero.

Coils 2,12 are wound of electrically conducting thin wire such as copper and comprises a plurality of turns electrically insulated from each other, e.g. by means of a surface layer of lacquer. The wire and the coils are heated during winding, whereby the lacquer becomes adhesive and adheres the windings to each other and thereby stabilises the coils mechanically. Each of the two coils—e.g. coil 2—has two wire ends for connecting that coil electrically to terminal 6 and 8 via electrically conducting paths on the inner side of diaphragm 1.

Figure 4:
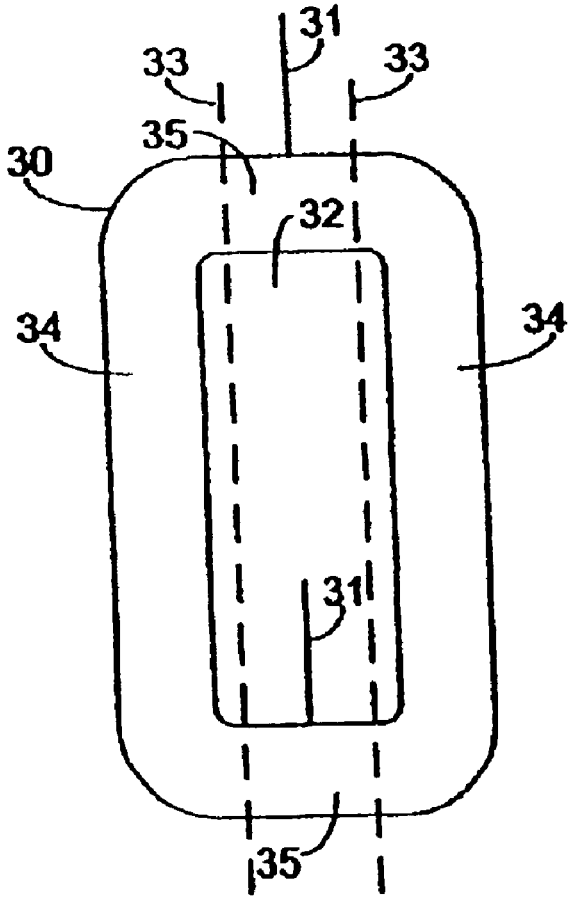
FIG. 4 shows the coils to be applied in the transducer according to the present invention.

Coils 2,12 are wound on a mandrel of generally rectangular cross section, whereby the coils are given the shape shown in FIG. 4 with a generally rectangular opening 32 and a generally rectangular outer contour with rounded corners. In FIG. 4 the coil is relatively flat and has a thickness, which is less than its radial width between its inner and outer contours—typically 10–30% of the radial width or according to the subsequent operations to be performed on the coils.

After the coils has been wound with the desired number of turns of wire and to the desired shape and thickness it is removed from the mandrel. While the coils are still warm, and the lacquer is still soft due to the elevated temperature, the coils are bent along two parallel bending axes 33 in the plane of the flat coil using a (not shown) bending instrument. The coils are hereby given the shape shown in FIGS. 1 and 2, where the two long sections 34 of the coils have been bent approximately 90 degrees relative to the two short sections 35, and the two long sections 34 are now parallel to each other. After the bending the coils are allowed to cool so that the lacquer is no longer flexible, and the coils stabilises. The bent and stabilised coils are then secured to diaphragms 1,13. For telecom applications, the diaphragms are fabricated from a thin and flexible sheet—e.g. of a flexible circuit board material. On its inner side, which is the side perceptible in the lower part of FIG. 2, diaphragms 1,13 have electrically conductive portions 25,26 of e.g. copper. The two short sections 35 of the coils are secured to the inner side of the diaphragms, e.g. by means of an adhesive, with the two wire ends 31 electrically connected to respective ones of the electrically conductive portions 25,26 e.g. by soldering or welding. The conducting portions may also be used for stiffening and stabilising the middle part of diaphragms 1,13 and for establishing the electrical contact from the coils to the terminals 6–9 as already mentioned. This also improves the reliability of the speaker since thin wires from the moving coils to the stationary terminals 6–9 are completely avoided. However, the wire ends may alternatively be electrically connected to terminals on the casing, e.g. by soldering.

In an alternative embodiment, the coil may be formed by a thin and flexible sheet, such as a flexible printed circuit board, i.e. a flexprint. Such thin and flexible sheet will comprise a predefined electrically conductive path thereon so as to form a coil-like electrical path. As explained later, the diaphragm will also, in its preferred embodiment, comprise electrically conductive portions. Therefore, the coil and diaphragm can be made from a single sheet of flexprint with appropriate conductive paths, and this sheet will be shaped in such a way that the two long sections of the coil will emerge and have an angle of 90 degrees with respect to the rest of the integrated diaphragm/coil structure. The diaphragms 1,13 are rectangular in shape, and tongues 24' extend from the long and bend sides of the diaphragms with the electrically conductive portions 25,26 extending to the tongues, so that the electrically conductive portions 25,26 on the tongues are electrically connected to respective ones of the coil wire ends 31.

Diaphragms 1,13 with coils 2,12 fastened thereto are then mounted on the magnetic system with the two long sections of coil 2 in upper portions of respective ones of the gaps. Similarly, the two long sections of coil 12 are positioned in lower portions of respective ones of the gaps. The long sections 34 are therefore also referred to as gap portions of the coil. The short sections 35 of the coils will be situated over the middle leg 29 and will bridge the gap portions of the coil.

The sections 35 will preferably be used to fasten the coil to the diaphragm, such as by adhesives. The coil may further be fastened to the diaphragm along at least part of one of the gap portions 34. The best mechanical coupling between the coil and the diaphragm is obtained by fastening the coil to the diaphragm along the entire length of both gap portions 34, such as using adhesives. This will improve the stiffness of the diaphragm and thus provide a more piston-like movement of the diaphragm.

The diaphragm will be secured to the magnetic system along its edges as shown in FIG. 3. If desired, the short edges of the diaphragm can also be secured to the magnetic system or to the casing, or, alternatively, the slot can be closed with a flexible substance so as to allow the short edges to move. However, the flexible substrate prevents air from going from one side of the diaphragm to the other. If desired, the edges of the diaphragm may be secured to the magnet system by means of an adhesive.

In the preferred embodiment the diaphragms are rectangular, but other shapes can be used.

The compliance of the surround of the diaphragms may be increased by means of laser perforation with holes. Even further, the general behaviour of the two diaphragms may be balanced by introducing holes in one or both diaphragms so as to obtain compliance between the two diaphragms.

The magnetic circuit shown in FIG. 1 is laminated from several layers. The magnetic circuit may also be made as one solid block or as an outer ring with the middle leg inserted therein.

FIGS. 1–3 also show that, on its sides, the two-part plastic housing 3,11 has a total of four grooves or channels extending in the long direction of the housing. These grooves are adapted to support terminal 6–9 as seen in FIG. 2. The channels have a height corresponding to the width of each of terminals 6–9. Diaphragm 1 is connected to terminals 6 and 8, whereas diaphragm 13 is connected to terminals 7 and 9. The connections between diaphragms and terminals may be established by providing the thin layer of e.g. tin on those parts of the diaphragms which upon assembling the transducer will obtain contact to the terminals. As seen in FIG. 1–3 a small hole has been provided in the diaphragm at each of these locations. These holes are adapted to allow a laser beam to heat, by heating the terminals, the diaphragm around these holes and thereby melt any e.g. tin provided to these areas. Applying this procedure to all four area to be connected to the terminals, the diaphragms are soldered to the terminal.

Figure 7:
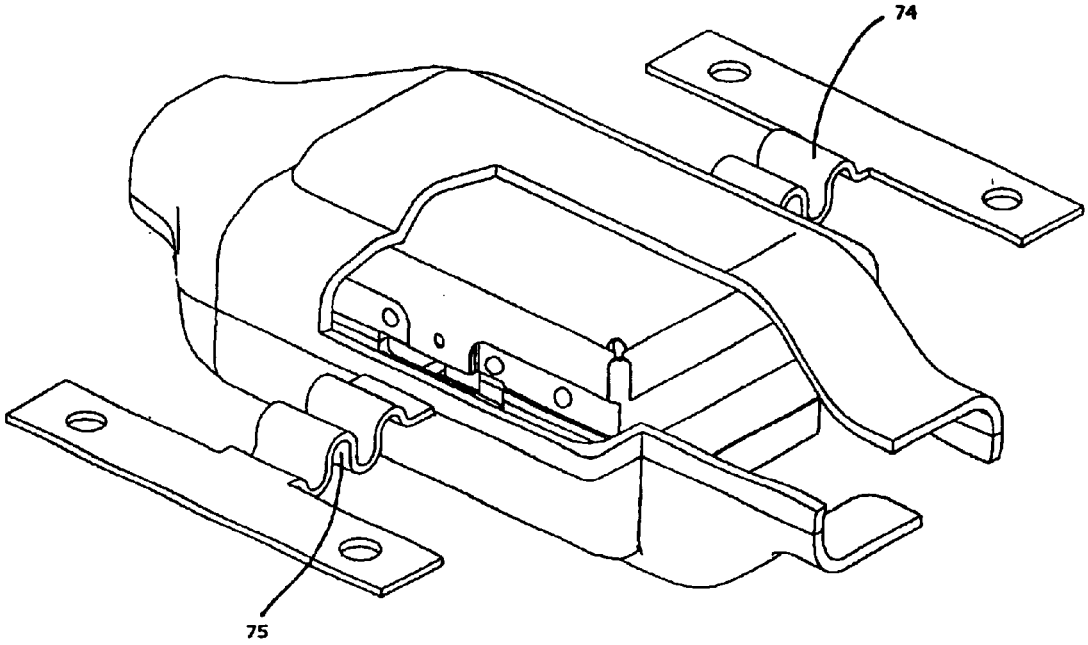
FIG. 7 shows a completely assembled transducer suspended in two flexible members.

To combine the output from the two diaphragms a housing around the speaker is required. Such housing is arranged in such a way that the outlets from the back volume is separated from the output from the front of the diaphragms. Both front and back output end in different acoustical outlets as shown in FIG. 7. As seen, the attachment to the surroundings may be established via a compliant rubber material 74,75 in such a way that a resonance around 100–150 Hz is achieved. Maximum generated output is achieved when the transducer is operated in vibration mode, which typically occurs in 100–150 Hz frequency area. An expected acceleration of around 1G can be achieved on a mass of 100 grams representing the mass of e.g. a mobile phone. Variations on the rubber attachment could be springs, plastic, silicone, or anything with the right compliance to get the resonance in the desired frequency range—i.e. within the range 100–150 Hz.

The transducer is equally suitable as a speaker transducer and as a microphone. When used as a speaker transducer, electrical signals at audio frequencies are supplied to the terminals, and the resulting current in the gap portions of the coils wire will interact with the magnetic field in the gaps and cause the coils and the diaphragms to move and generate sound at the audio frequencies. Likewise when used as a microphone, sound at audio frequencies acting on the diaphragms will cause it to move, and when the gap portions of the coils wire move in the magnetic field electrical signals will be generated and output on the terminals of the transducer.

The transducer according to the present invention may also be used as a ringer by tuning the transducer in its application to have a resonance peak at around 1.5 kHz-alternatively between 800 and 3 kHz.

The double diaphragm transducer can generally be operated in two modes—the two diaphragm-coil systems being electrically coupled in phase (the diaphragms move in opposite directions) or out of phase (the diaphragms move in the same direction). The transducer can be used as an efficient loudspeaker with spherical directivity pattern when coupled in phase. When coupled out of phase the transducer is a substantially silent vibration source. Correspondingly, when used as microphone, the transducer can either have a spherical or a lemniscatical (figure-of-eight) directivity pattern.

For applications such as within mobile communication equipment, the double diaphragm transducer is very attractive since it can serve as a loudspeaker by normal operation mode as well as vibration source for providing a silent alarm signal. Thus, serving two functions the double source transducer saves space, weight and reduces the total number of single components.

For special applications it may be interesting that the directivity pattern of the double diaphragm transducer can be controlled in more detail by applying appropriate signal processing. However, the frequency range where this is possible depends, among other features, on the size of the diaphragm.

Regarding games on portable unit, one could think of a mode that is a mix of vibration and sound output to stimulate also the user by mechanical means instead of only by image and sound. The reason for this being that the present invention may be easily switched between vibration mode and sound mode by simply switching polarity on one of the signals supplied to one of the coils.

Regarding hearing aids, major problems exist in relation to feedback. Feedback means that vibrations generated by the receiver (speaker) is mechanically coupled/transferred to the hearing aid housing, and is thereafter converted in to sound again, which enters the microphone resulting in feedback. Even sometimes, direct coupling between speaker and microphone in a hearing aid is also an issue.

The present invention provides a complete cancellation of vibrations because the movements of the diaphragms introduce no rotational component. This is especially determined by the fact, that the diaphragm is driven by the reasonably stiff coil and the drive points are spaced far apart and everything else is very symmetrical. The only difference can be the compliance differences of the diaphragms.

One possible way to optimise for this could be to use the back volume in such a way that the back volume determines largely the compliance of the diaphragms. Since the back volume is the same for both diaphragms this would help a lot. In this case there should be one diaphragm, which is acoustically sealed to the outside world. This is necessary anyway for a hearing aid application where a good low frequency response is required. A pressure equalisation hole has to be made in only one diaphragm.

Another way could be to use the laminar parts for the magnetic circuit to construct an acoustic low-pass filter—see again FIG. 6. Usually in a hearing aid it is not allowed to have an opening in the back volume, because sound emitted from such an opening would be emitted inside the hearing aid resulting in feedback as discussed earlier. The acoustic low-pass filter can be made with a cut-off frequency so low (say sub 1 Hz) that the sound level from higher frequencies would not be sufficient to cause feedback.

A common acoustic chamber that combines the output from the diaphragms and the output of a canal may be established so that where the canal terminates, the output from the diaphragms and the output from the canal has the same phase for a certain frequency range—similar to a bass reflex loudspeaker.

The magnetic circuit in the present transducer is designed in such a way that AC flux of the two coils driven with opposite polarity will cancel out. This will drastically reduce the need for shielding for magnetic feedback to a tele-coil. A consequence of this would be that in low gain hearing aids one could use a plastic housing (cost reduction) and in high gain hearing aids the requirements for shielding are much lower. The pole shoe stack in itself is a complete self-enclosed magnetic circuit, which has good shielding properties anyway.

Regarding mechanical stability, the pole shoe, which preferably is built as a laminated structure, is very stiff. A housing in direct contact with laminated structure will be able to move and displace. This very stiff construction will be a big improvement because such a stiff housing will also radiate less sound compared to a hearing aid receiver of today, which has a more compliant housing.

Figure 5:
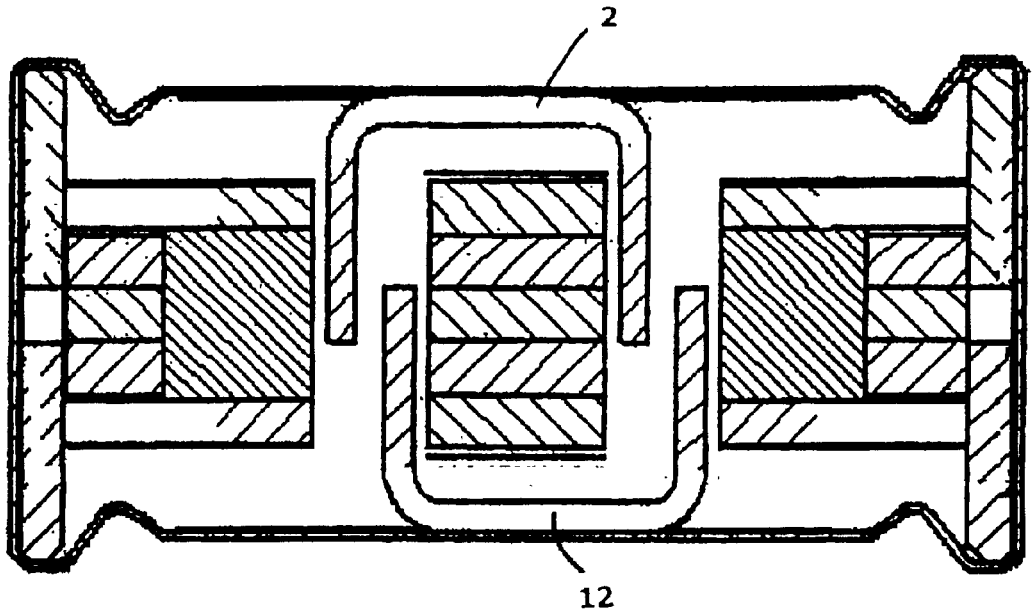
FIG. 5 shows a cross-sectional view of another embodiment of the invention suitable for hearing aids applications.
Figure 8:
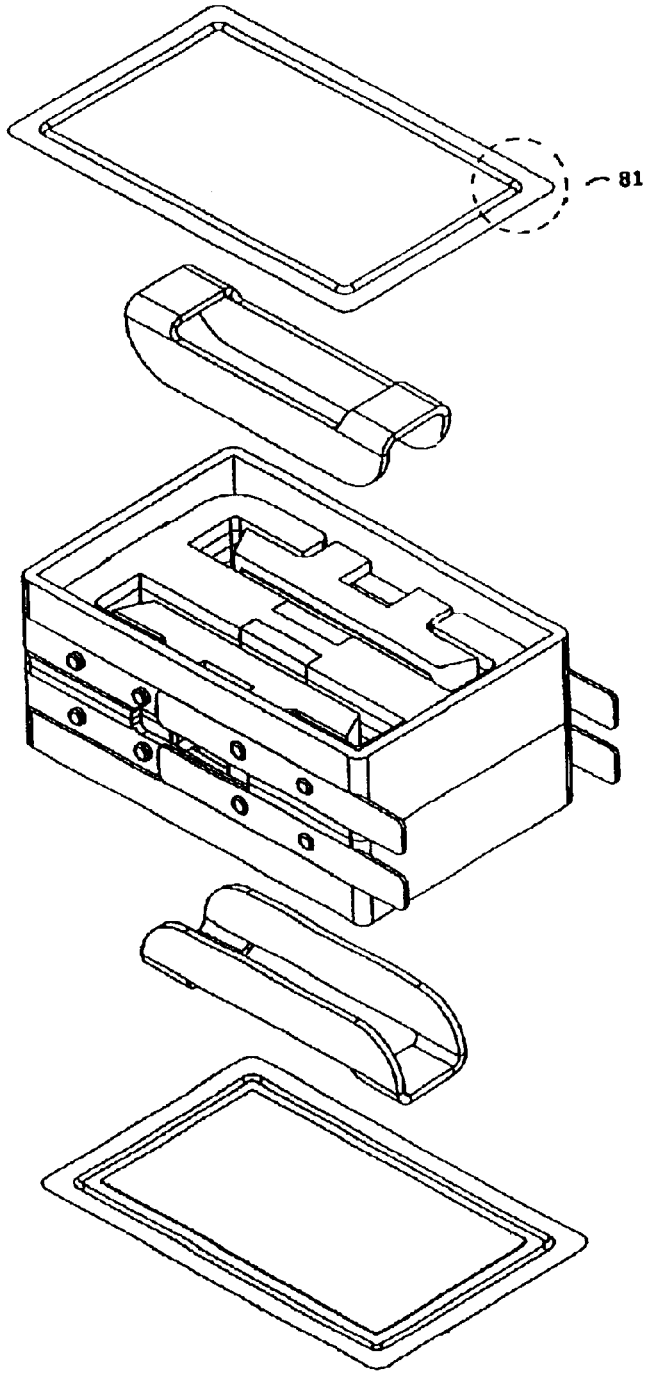
FIG. 8 shows a transducer suitable for use with hearing aids.
Figure 9:
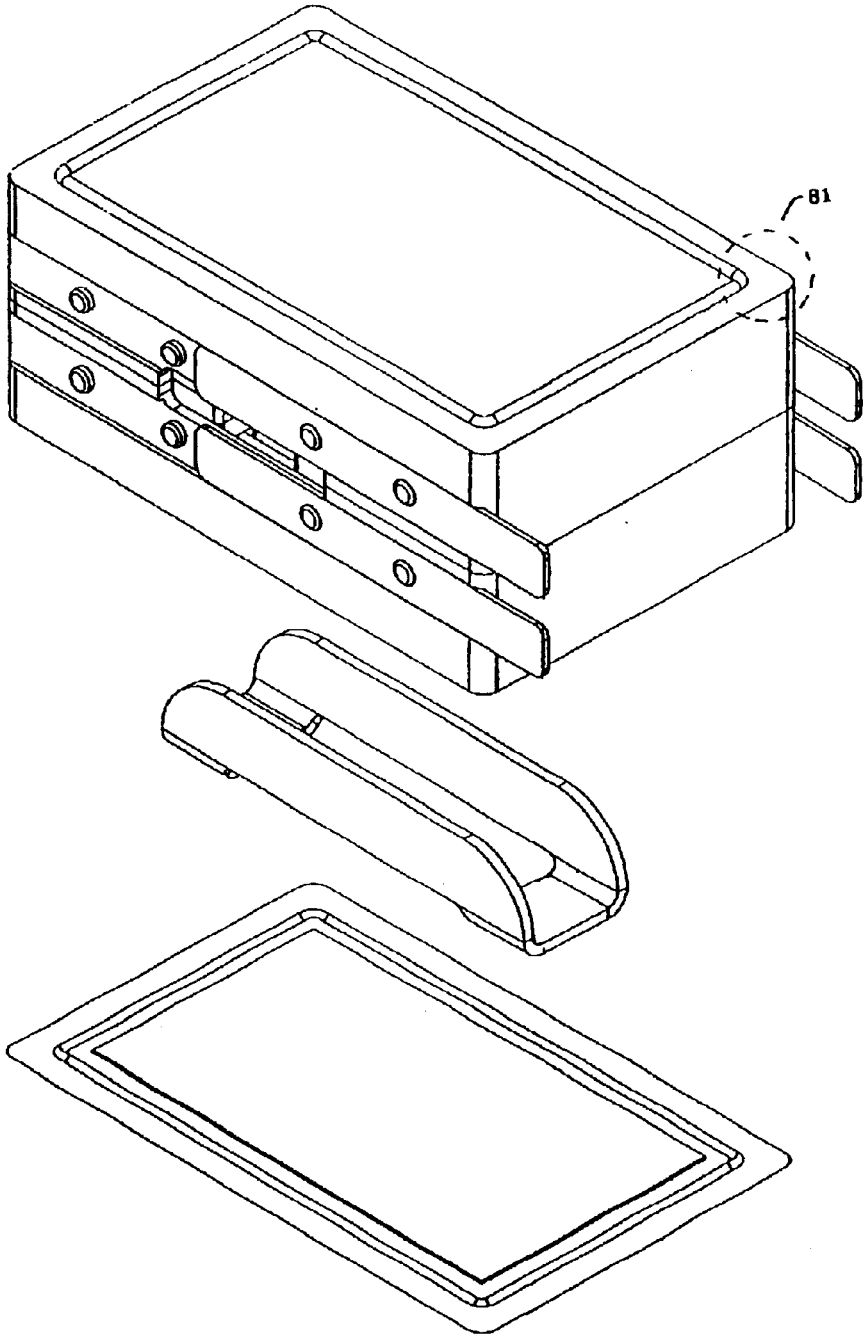
FIG. 9 shows the same parts (as in FIG. 8) partly assembled.

For hearing aid applications it is very important to have a thin transducer. An way of thinning the structure of FIGS. 1–3 would be to have the coils 2,12 fall over each other, so they share together the same gap as illustrated in the cross-sectional view of FIG. 5. Such a construction would cause some efficiency loss due to a bigger gap, but the thickness would be considerably smaller. Also for hearing aid applications, a different type of diaphragm with closed corners 81 is required. A transducer having such diaphragms is illustrated in FIGS. 8 and 9.

Electronic means may be mounted on at least one of the diaphragms, such electronic means being able to serve different purposes. The electronic means may be contained in a single chip to be mounted by means of adhesives. In case the impedance of the transducer coil is too low to operate with traditional electronic amplifier equipment, used for instance within mobile phones, the electronic means may comprise an impedance converter. For instance such a chip may be mounted on the coil side of the diaphragm. With an impedance converter it is possible to improve the efficiency of the transducer since it is possible to improve the filling of the magnetic gap with electrically conducting wire by reducing the number of single windings of the coils. This is especially important in case of embodiments where at least one of the diaphragms is a flexprint with integrated coil. With this solution the filling will decrease significantly by increasing the number of windings since conducting material has to be removed in order to create more windings. Using the impedance converter enables a compensation for the lower impedance by reducing the number of windings, thus improving the efficiency of the transducer.

The electronic means may comprise means for detecting movements of the diaphragm for example in combination with feedback systems. The electronic means may also comprise switching means such as means for switching between sound and vibration mode, in case the transducer is used as a loudspeaker. The electronic means may also comprise an attenuator for adjusting volume.

In the preferred embodiment the magnet circuit is rectangular, and there are two gaps receiving the gap portions of the coils, where the gaps are defined between opposed plane surfaces. In another configuration the magnet circuit could have four gaps arranged like the sides of a square, and the coils would then correspondingly have four gap portions likewise arranged like the sides of a square. The bridging portions of the coils would then be at the corners of the square and be secured to the diaphragms at four locations. The outer contour of the magnet circuit can have any desired shape including circular shape. Also, the gaps and the gap portions of the coils can be curved as arcs of a circle.

What is claimed is:

1. An electro-acoustic transducer comprising a magnetic circuit having a first and a second gap, each of the first and second gaps having an upper and a lower portion, the magnetic circuit further comprising magnetic means so to establish a magnetic field in the first and second gaps, a first and a second diaphragm situated on opposite sides of the magnetic circuit, a first coil of electrically conducting wire fastened to the first diaphragm, the first coil having first and second gap portions of its wire situated in respective ones of the upper portions of the first and second gaps, the first coil further having bridging portions of wire interconnecting the first and second gap portions of wire, the first coil being fastened to the first diaphragm at least at the bridging portions of the wire, and a second coil of electrically conducting wire fastened to the second diaphragm, the second coil having first and second gap portions of its wire situated in respective ones of the lower portions of the first and second gaps, the second coil further having bridging portions of wire interconnecting the first and second gap portions or wire, the second coil being fastened to the second diaphragm at least at the bridging portions of the wire.

2. A transducer according to claim 1, wherein the first coil is fastened to the first diaphragm along at least part of one of its gap portions.

3. A transducer according to claim 2, wherein the second coil is fastened to the second diaphragm along at least part of one of its gap portions.

4. A transducer according to claim 1, wherein each of the first and second gaps is defined by a pair of opposed surfaces, said pair of opposed surfaces being substantially plane and substantially parallel to each other.

5. A transducer according to claim 1, wherein the magnetic means comprises a first and a second permanent magnet, the first magnet establishing a magnetic field in the first gap, the second magnet establishing a magnetic field in the second gap.

6. A transducer according to claim 5, wherein the magnetic circuit comprises a body of magnetically soft material, said body having a first and a second opening.

7. A transducer according to claim 6, wherein the first magnet is situated within the first opening of the body, and wherein the second magnet is situated within the second opening of the body.

8. A transducer according to claim 7, wherein the first gap is formed by opposed surfaces of the first magnet and a first long leg of the body of magnetically soft material, and wherein the second gap is formed by opposed surfaces of the second magnet and a second long leg of the body of magnetically soft material.

9. A transducer according to claim 7, wherein the first gap is formed by opposed surfaces of the first magnet and a middle leg of the body of magnetically soft material, and wherein the second gap is formed by opposed surfaces of the second magnet and the middle leg of the body of magnetically soft material.

10. A transducer according to claim 1, wherein the diaphragms comprise electrically conductive portions, said electrically conductive portions being connected to wires ends of the coils, the electrically conductive portions being externally accessible portions for electrically termination the transducer.

11. A transducer according to claim 1, wherein a spatial overlap exists between the upper and lower portions of the respective ones of the first and second gaps.

12. A transducer according to claim 1, wherein the upper and lower portions of the respective ones of the first and second gaps are spatially separated.

13. A transducer according to claim 1, wherein a flexible circuit board forms the first diaphragm, and wherein the first coil is formed by electrically conducting paths on the flexible circuit board.

14. A transducer according to claim 13, wherein the flexible circuit board is a flexprint.

15. A transducer according to claim 1, wherein a flexible circuit board forms the second diaphragm, and wherein the second coil is formed by electrically conducting paths on the flexible circuit board.

16. A transducer according to claim 15, wherein the flexible circuit board is a flexprint.

17. A transducer according to claim 1, further comprising electronic means mounted on at least one of the diaphragms.

18. A transducer according to claim 17, wherein the electronic means comprise an impedance converter.

19. A magnetic circuit in the transducer according to claim 1, the magnetic circuit comprising a magnetically conductive material formed so as to define a pair of opposed surfaces defining a gap therebetween, said gap being adapted to receive portions of a first and a second coil of electrically conducting wire, and a magnetic means so as to establish a magnetic field in an upper and a lower portion of the gap, the upper portion being adapted to receive portions of the first coil, the lower portion being adapted to receive portions of the second coil.

20. A magnetic circuit according to claim 19, wherein each pair of opposed surfaces has substantially plane surfaces being parallel to each other.

21. A magnetic circuit according to claim 20, wherein the magnetic means comprises permanent magnets, each of said permanent magnets having a substantially plane surface constituting one of the substantially plane surfaces of a gap.

22. A magnetic circuit according to claim 19, wherein the magnetic circuit comprises a body of magnetically soft material formed so as to define two openings within the body, each opening having a pair of opposed surfaces defining respective ones of the first and second gaps.

23. A magnetic circuit according to claim 22, wherein the magnetic means is situated within the openings in the magnetic circuit.

24. A method of operating the transducer according to claim 1, wherein the first and second diaphragms deflect in the same direction upon providing, simultaneously, the same electrical signal to the first and second coils.

25. A method of operating the transducer according to claim 1, wherein the first and second diaphragms deflect in opposite direction upon providing, simultaneously, the same electrical signal to the first and second coils.

* * * * *